US005522941A

United States Patent [19]

Uchinami et al.

[11] Patent Number: 5,522,941

[45] Date of Patent: Jun. 4, 1996

[54] UNDERWATER WASHING METHOD AND DEVICE

[75] Inventors: Toshiro Uchinami; Tadao Nishikawa, both of Nishitama-Gun, Japan

[73] Assignee: Uchinami Co., Ltd., Tokyo, Japan

[21] Appl. No.: 183,831

[22] Filed: Jan. 21, 1994

[30] Foreign Application Priority Data

Jan. 21, 1993 [JP] Japan ..... 5-026078

[51] Int. Cl.[6] ..... B08B 7/04

[52] U.S. Cl. ..... 134/37; 134/22.18; 134/36; 134/102.1; 134/102.2; 261/77; 261/87

[58] Field of Search ..... 134/22.18, 36, 134/37, 102.1, 102.2; 261/77, 87

[56] References Cited

U.S. PATENT DOCUMENTS

| | | | |
|---|---|---|---|
| 1,808,956 | 6/1931 | Ketterer | 261/77 |
| 1,864,135 | 6/1932 | Hill | 134/102.1 X |
| 3,938,738 | 2/1976 | Nagel et al. | 239/9 |
| 4,162,970 | 7/1979 | Ziokarnik | 210/15 |
| 4,308,138 | 12/1981 | Woltman | 210/220 |
| 4,690,764 | 9/1987 | Okumura et al. | 210/629 |
| 4,806,277 | 2/1989 | Sakurai et al. | 252/626 |
| 5,032,186 | 7/1991 | Childers et al. | 134/25.2 |

FOREIGN PATENT DOCUMENTS

| | | |
|---|---|---|
| 3-56691 | 5/1991 | Japan . |
| 3-109981 | 5/1991 | Japan . |

*Primary Examiner*—David L. Lacey
*Assistant Examiner*—Sean Vincent
*Attorney, Agent, or Firm*—Jacobson, Price, Holman & Stern

[57] ABSTRACT

A method and device for jetting a pressurized water flow against a material under water to cause cavitation to wash the material. A negative pressure generated by the pressurized water flow is used to draw an air current and mix it into the pressurized water flow. A near-infinite number of bubbles are thus directed to the material through the pressurized water flow. As a result, the control of the water flow controls the movement of the bubbles, and the disturbance caused by the bubbles, the shock wave caused by the bursting of the bubbles, and the turbulent force of the flow serve to wash the material.

11 Claims, 6 Drawing Sheets

UNDERWATER WASHING METHOD AND DEVICE

FIELD OF THE INVENTION

The present invention relates to an underwater washing method and device for washing dependent upon water.

DESCRIPTION OF THE PRIOR ART

Conventionally, the use of special detergents such as freon, or organic or petroleum solvents has been essential in washing methods, particularly these for industrial washing applications. However, freon solvents are considered harmful to the ozone layer and organic solvents may contaminate underground water, rivers, and coastal waters and have a secondary effect on human beings.

Thus, the inventor has already developed a method for effective washing dependent upon water and a device for implementing such a washing method and applied part of the results as Japanese Patent Laid-Open No. 3-109981 and Japanese Utility Model Laid-Open No. 3-56691. These inventions achieve an intended washing effect using a washing means that jets washwater and bubbles onto a material under water and comprises three elements: vibrations and oscillations caused by bubbles, water hammer energy generated by the jet's pressurized water flow, and the fast movement of the bubbles caused by turbulence.

In these inventions, the material is located in the bubbles direction of movement so that the bubbles are effectively jetted against the material. The material is suspended and supported so that its bottom surface is exposed, and the pressurized water flow is jetted upward against the material to cause cavitation because the bubbles have the largest kinetic energy when they are blown upward.

Due to the methods used in these inventions, however, mainly the bottom surface of the material is washed because the bubbles must be blown upward. The intended washing effect cannot be achieved by jetting the bubbles against the target part of the material in a sideways or downward direction because the bubbles' direction of movement and velocity cannot be completely controlled. For example, if the target part of the material is not at the bottom, the material's orientation must be changed. Also, piping for blowing up bubbles, pressurized water piping, and a supporting facility for the material must be provided at the bottom of a washing vessel. This composition makes the bottom of the vessel complex and reduces the effective height in the vessel.

SUMMARY OF THE INVENTION

In consideration of the above points, the objective of this invention is to control the movement of the bubbles so that they can be jetted against the target part of the material properly.

That is, the bubbles and pressurized washwater flow will be jetted against the material not only upward but also frontward, backward, rightward, leftward, and downward to improve the practicality of the underwater washing method to make it more versatile.

It is an object of the invention to provide a method for jetting a pressurized water flow against a material immersed in washwater to cause cavitation in the water flow that washes the material, the washing process consists of two steps: an air-current suction step, in which negative pressure generated by the pressurized water flow is used to suck in an air current in order to introduce a fast air current into the washwater; and a washing step, in which the material is washed by the combination of the air current and pressurized water, the fast-moving bubbles generated by cavitation, the shook waves caused by the bursting of the bubbles, and the turbulent force of the pressurized water flow.

The air current is sucked under by the pressurized water flow to form bubbles, which are then transferred to the material within the pressurized water flow while agitated. Therefore, the jetting direction and velocity of the bubble can be controlled by the pressurized water flow.

A device for implementing the above underwater washing method preferably comprises a washing vessel that can store washwater for immersing the material, a pressurized water piping with a nozzle for jetting the pressurized water through the wash water in the washing vessel, and an air current piping that guides the air current between the outer circumference of the nozzle and a tip opening, which has a form that surrounds the nozzle and protrudes toward the inside of the washing vessel further than the nozzle.

In addition to industrial water, either pure water or general city water can be used as wash water. Warm water is more effective than chilled water, so water of approximate room temperature to 80° C. is used. Moreover, the washwater must be pressurized before jetting. A pressure of several $kg/cm^2$ is effective but pressure of several tens to more than 150 $kg/cm^2$ is generally used. However, no definite values have not been proposed. The pressure applied to the water flow should be based on the distance between the nozzle and the material, the type of stain on the target area, and the degree and intensity of staining. The optimum pressure for various stains varies according to individual conditions because the pressure controls kinetic properties, of bubbles generated by capitation, such as the vibration frequency. The pressurized water flow is jetted either continuously or intermittently. Although conventional detergents are not used, alkaline detergents can be used depending upon the conditions of the material, and antiseptics may be used to wash iron or alum. material. In this sense, this invention may be thought of as a washing method using only washwater.

DETAILED DESCRIPTION OF PREFERRED EMBODIMENTS

This invention is described below with reference to the drawings.

Figure 1:
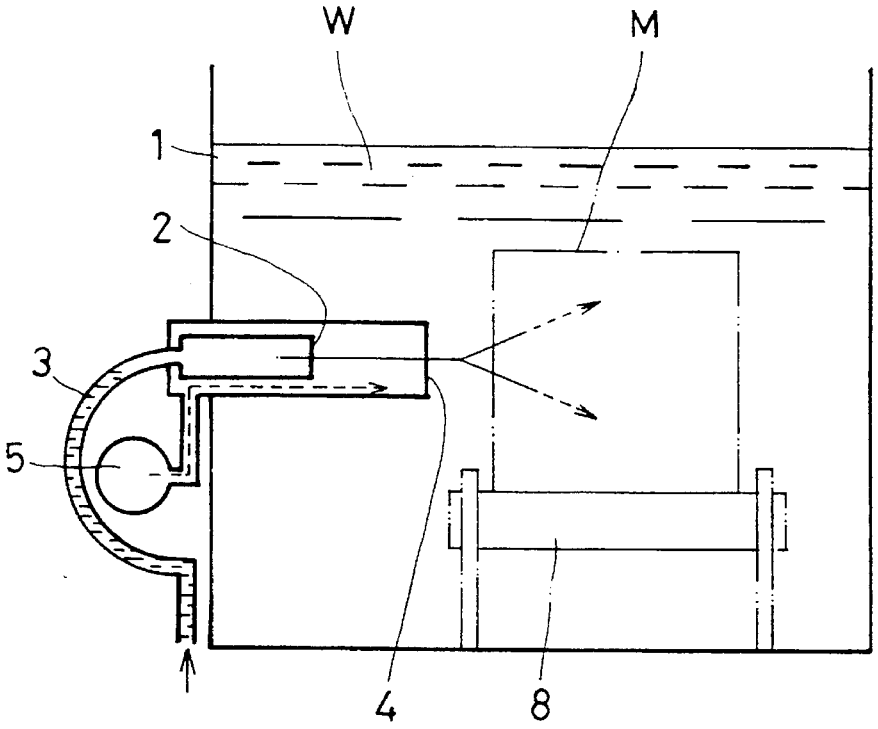
FIG. 1 is an explanatory side elevation view of embodiment 1 of an underwater washing method and a device according to this invention.

[1] FIG. 1 shows a basic embodiment 1 of an underground washing method and a device according to this invention.

Washwater W is stored in a washing vessel 1 that has an adequate content volume and a material M is immersed in the washwater W. In embodiment 1, the target part, of material M which is the side, is washed. A pressurized water piping 3 with a nozzle 2 which jets a pressurized water flow against the material M is provided on the sidewall of the washing vessel 1; a tip opening 4 has a size and form suitable to surround the nozzle 2 has protrudes on one end toward the inside of the washing vessel 1 further than the nozzle 2, while the other end of the tip opening 4 leads to the outside air or to a gas source via an air current piping 5. With embodiment 1, good results were obtained when pressure on the order of 150 kg/cm2 was applied to the washwater W. The magnitude of the pressure is adjusted depending upon the strength and degree of staining of material M. The material M is supported by an adequate supporting means 8.

When the pressurized water flow is jetted against the material M by the nozzle 2, the water flow collides with the target part of the material M and washes the area of collision and its periphery. At the same time, the outer circumference of the nozzle 2 acts as an accelerating throat to generate negative pressure, the air current around the nozzle 2 is then introduced into the washing vessel 1 by negative pressure suction (the air-current suction step). The air current continuously introduced is supplied from the atmosphere or a gas source. The air current is mixed in the pressurized water flow jetted from the nozzle 2 into the washing vessel 1.

Thus, the pressurized water flow carries a near-infinite number of bubbles and collides against the target part. The bubbles sucked under by the pressurized flow and agitated intensely while being transferred through the washwater by the pressurized water flow. Therefore, the bubbles direction of movement follows the direction that the pressurized water flow is jetted. That is, the motion of the bubbles can be controlled by the pressurized water flow. The bubbles absorbed into the flow move rapidly and collide against the material M to cause cavitation, and the target area is washed by the pressurized water flow hammering the target area and the strong shock wave that occurs when the fine bubbles generated by capitation burst (washing step).

Figure 2:
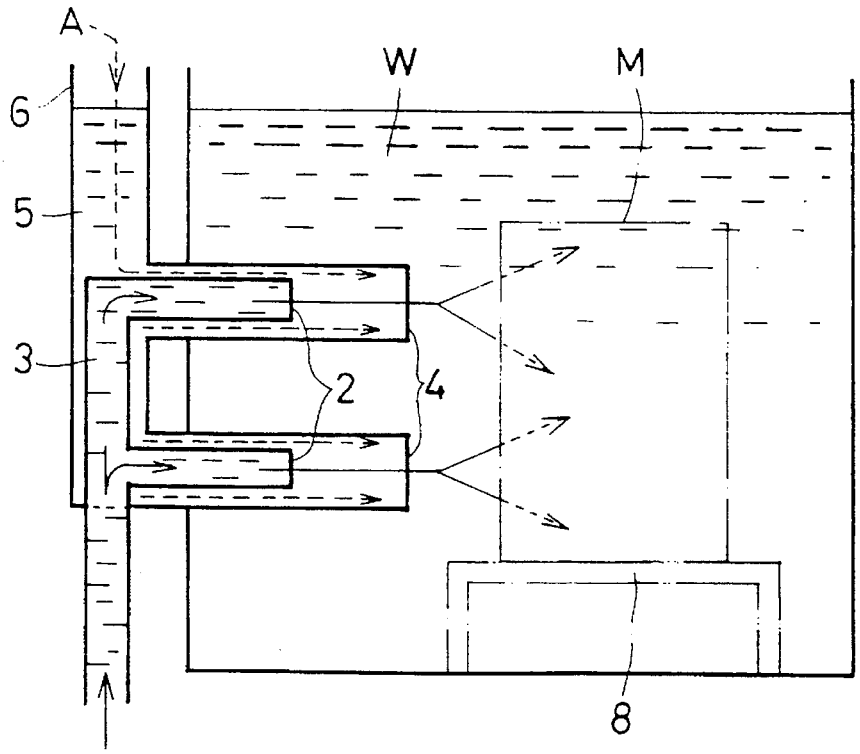
FIG. 2 is an explanatory side elevation view of embodiment 2.

[2] FIG. 2 shows embodiment 2, wherein air is pressurized and mixed into the pressurized water flow to increase the specific volume of the washwater that collides against the material M. Except for this point, the basic underground washing method and device are the same as those in [1].

In FIG. 2, two nozzles 2 that jet a pressurized water flow against the material M are provided on the sidewall of the washing vessel 1 and air current piping 5 is provided to supply pressurized air to the tip openings 4, which have a size and form suitable to surround each nozzle 2. The air current piping 5 leads to the washwater W in the washing vessel 1 as a communication pipe, and a supply piping 6 connected at the external end of the piping 5 supplies pressurized air A.

In FIG. 2, as soon as the pressurized water flow is jetted from the nozzle 2, the washwater W which was in the air current piping 5 and was originally in communication with the inside of the washing vessel 1 returns to the inside of the washing vessel 1. An air current is introduced into the washing vessel 1 by suction and the application of pressurized air causes an even larger air current to be sucked under by the pressurized water flow and jetted into the washwater.

Thus, the size of the air current mixed into the pressurized water flow is significantly increased and the specific volume of water is also increased to increase the size of the target area receiving water.

Figure 3:
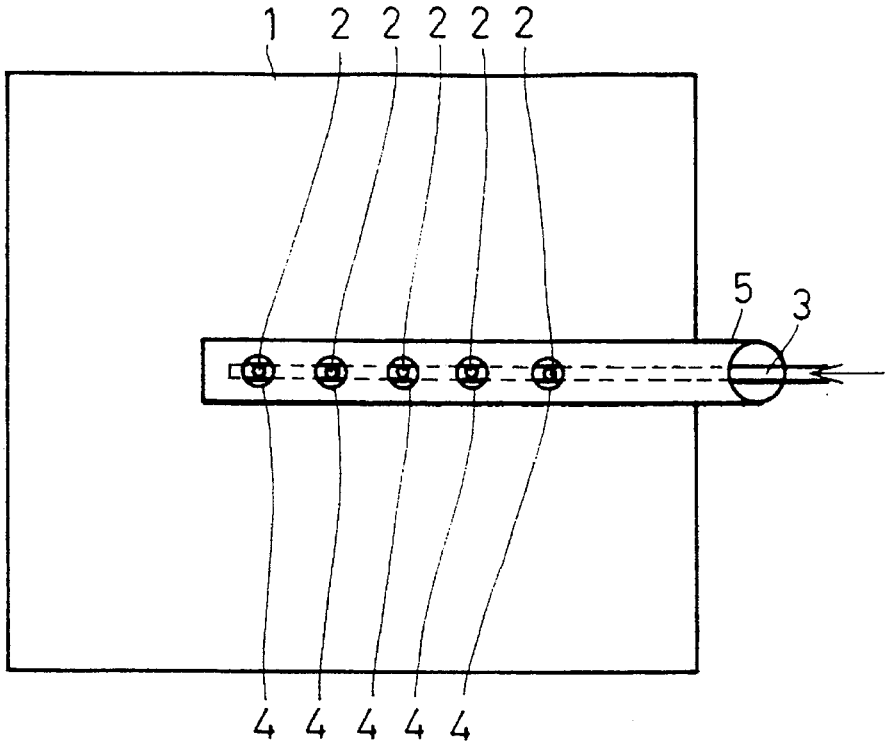
FIG. 3 is an explanatory plan view of embodiment 3.
Figure 4:
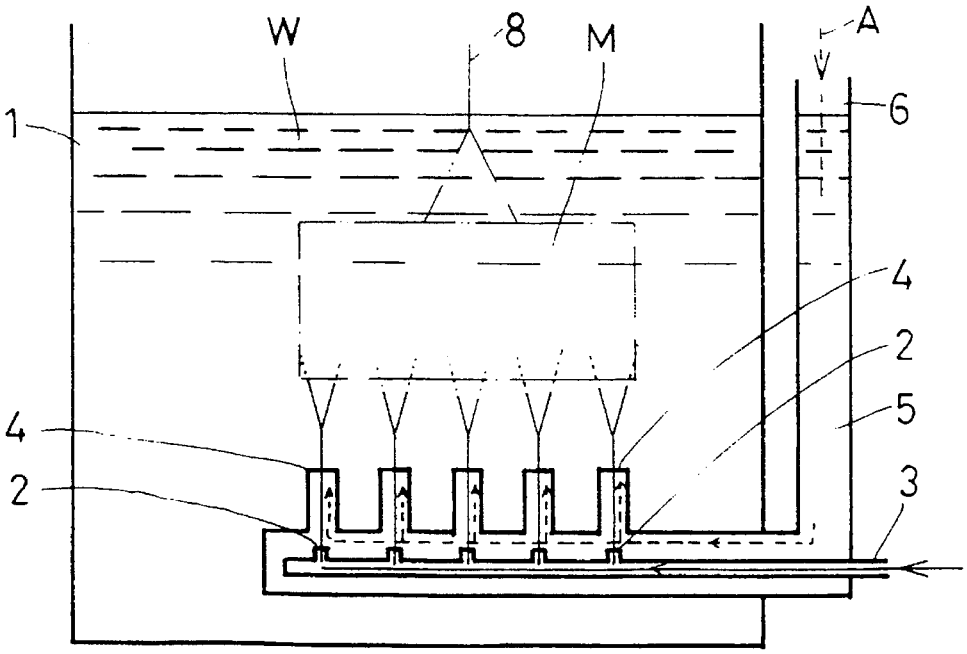
FIG. 4 is an explanatory side elevation view of embodiment 3.

[3] The embodiment 3, shown in FIGS. 3 and 4, has additional nozzles 2 and tip openings 4 that surround the nozzles 2. The nozzles 2 and tip openings 4 are installed at the bottom of a washing vessel 1 to jet washwater and air currents upward. The increased numbers of nozzles 2 and tip openings 4 make this embodiment effective if the target area is large or if several specific points must be intensively washed. Embodiment 3 is the same us embodiment 2 in that the supply piping 6 is connected to the external end of the air-current piping 5 to supply pressurized air A and that an air current suction step and a washing step are involved.

Figure 5:
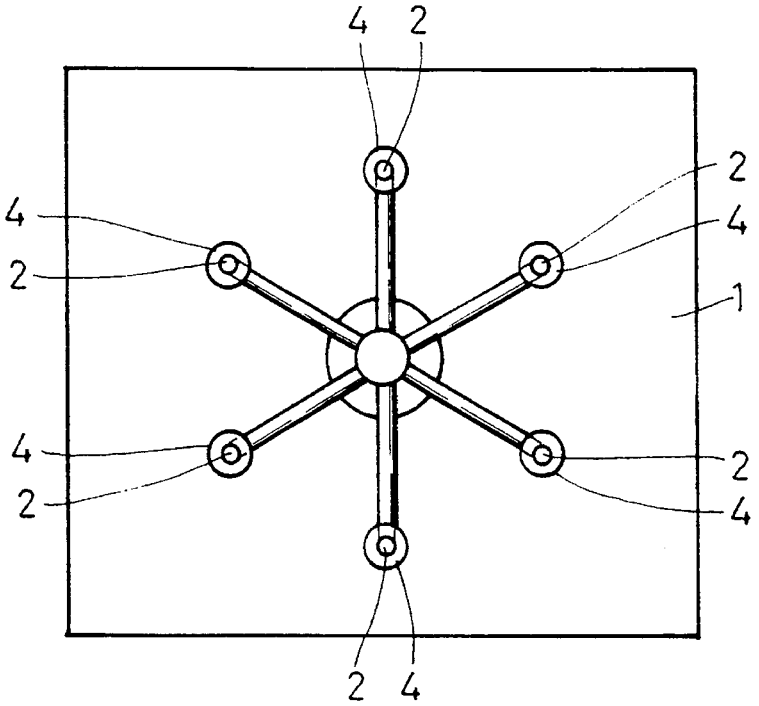
FIG. 5 is an explanatory front elevation view of embodiment 4.
Figure 6:
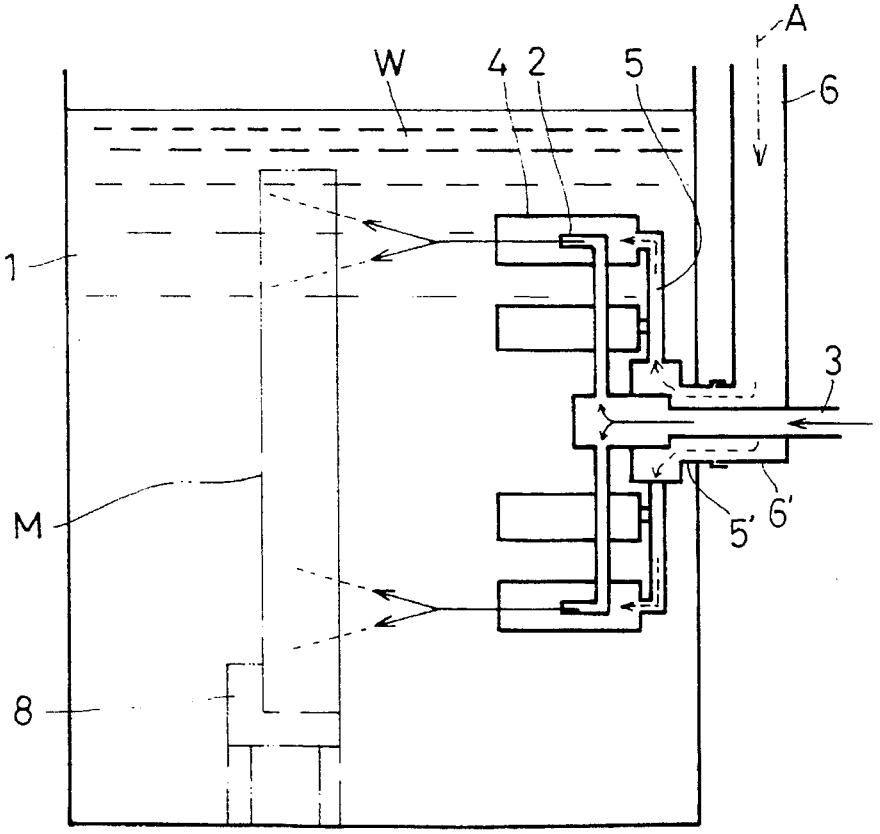
FIG. 6 is an explanatory side elevation view of embodiment 4.

[4] Embodiment 4 has a part comprising nozzles 2 and tip openings 4 surrounding the nozzles 2 which rotates relative to the material M; it also has the radial nozzle configuration shown in FIGS. 5 and 6. The washing method is based on embodiment 1, as are embodiments 2 and 3.

The nozzles 2 branches radially from the pressurized water piping 3. The tip openings 4 that surround the nozzles 2 and protrude toward the inside of the washing vessel 1 further than the nozzles 2 are provided for individual nozzles, and these openings 4 extend radially from a rotational cylindrical part 5'. The rotational cylindrical part 5' is connected to a central cylindrical part 6' following the supply piping 6.

As in embodiment 3, this embodiment 4 uses a pressurized water flow jetted from the nozzles 2 to generate a negative pressure, which is used to suck in the air current. The pressurized air A is also applied and the pressurized water flow with bubbles is jetted to cause cavitation. However, in this embodiment, the nozzles 2 and tip openings 4 are rotated. The pressurized water flow and air current jetted from the nozzles 2 and tip openings 4 are twisted spirally to significantly increase the incidence of cavitation.

Figure 7:
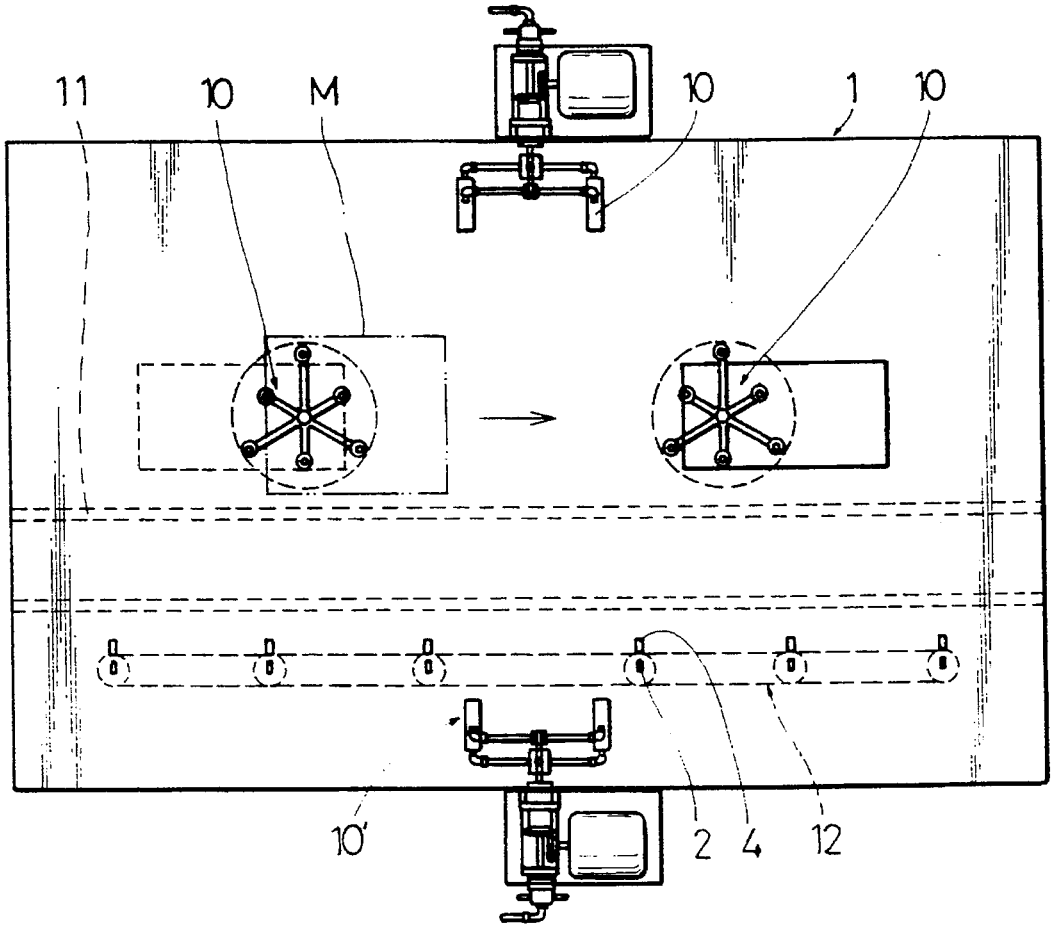
FIG. 7 is an explanatory front elevation view of embodiment 5.
Figure 8:
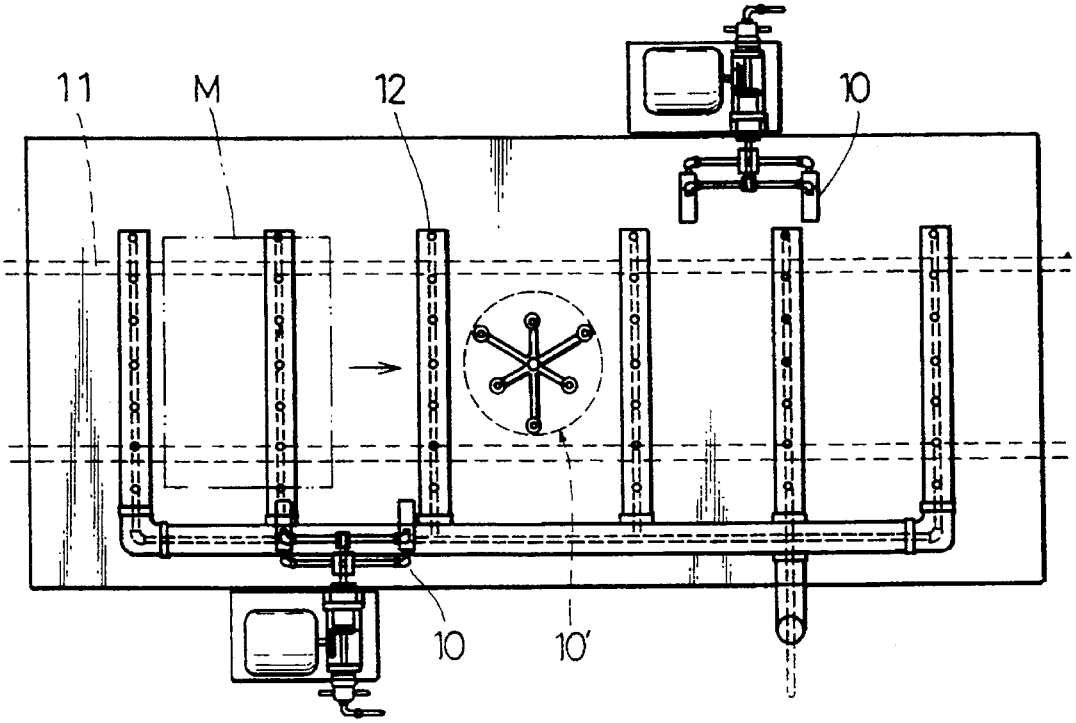
FIG. 8 is an explanatory top view of embodiment 5.
Figure 9:
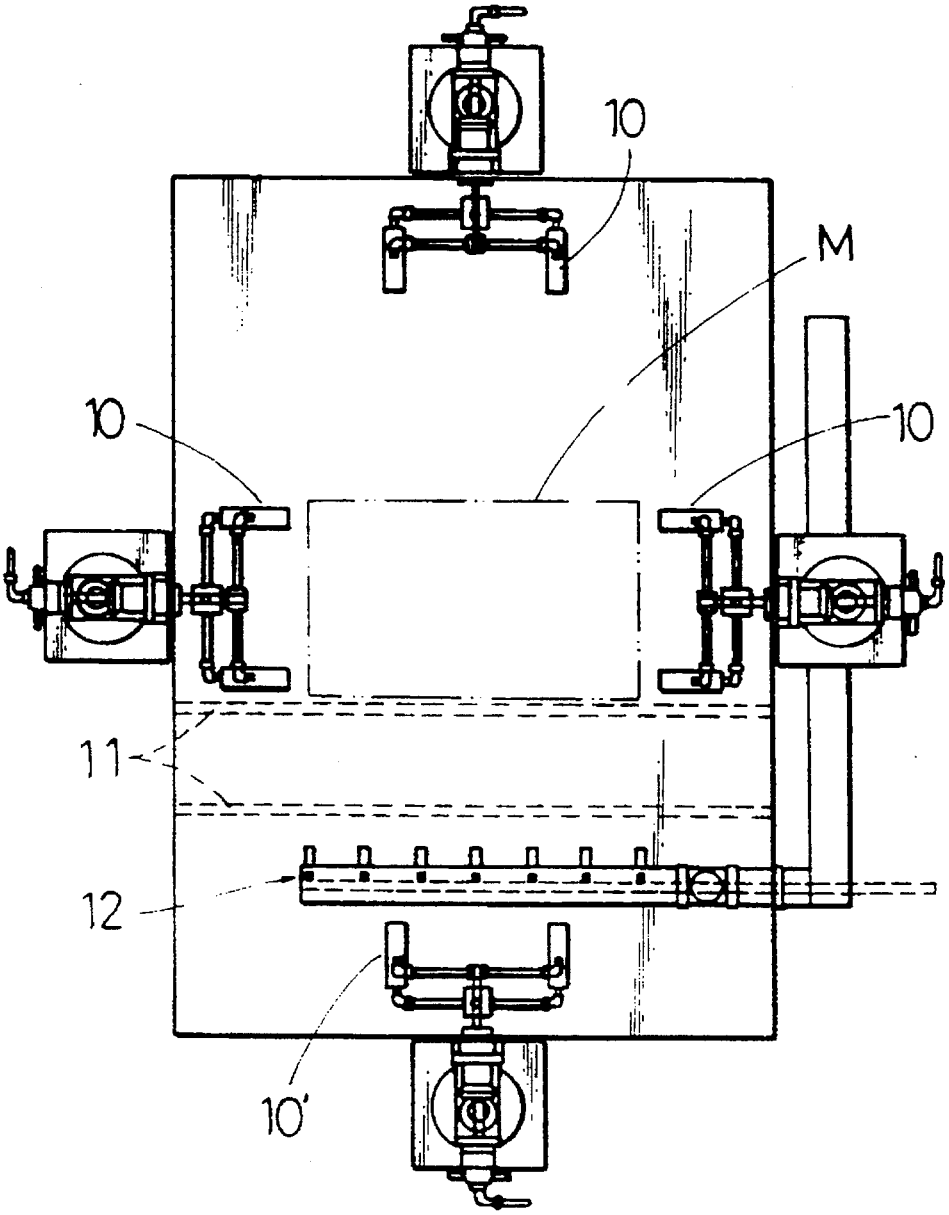
FIG. 9 is an explanatory side elevation view of embodiment 5.

[5] Embodiment 5 is shown in FIGS. 7, 8, and 9 wherein the rotational washing device 10 shown in embodiment 4 is provided on the front, rear, top, and bottom sides of a washing vessel 1. FIG. 7 is a front elevation view, FIG. 8 is a plan view, and FIG. 9 is a side elevation view. As is apparent from the drawings, a moving means 11 that moves the material M in washwater and also acts as a supporting means 8 is provided in the vessel 1. As a lower washing device 10' is used to blow washwater and an air current upwards from under the moving means 11, the moving means 11 is formed of a grid-like conveyor to pass the water flow and air current.

Embodiment 5 further includes a upward-blowing means 12 between the moving means 11 and the lower washing device 10' which comprises many nozzles 2 and many tip openings 4 that guide the air currents sucked in and introduced by the nozzles 2. Therefore, embodiment 5 uses the rotational washing device 10 in embodiment 4 and the lower washing device 10' to surround the overall material M. This arrangement enables all the faces of the material M to be washed simultaneously.

The underwater washing method according to this invention does not simply blow bubbles upward or simply jet a water flow containing bubbles but uses a pressurized water flow to suck an air current so that a fast air current can be introduced into the washwater and sucked under by the water flow. Thus, cavitation results from the underwater jetting of the pressurized water flow and a near infinite number of bubbles are jetted against the material. Therefore, the pressurized water flow can completely control the movement of these bubbles. Since the air current thus moves through the washwater along with the pressurized water flow, the jetting direction of the pressurized water flow can be controlled and adjusted to allow the air current to be jetted against the material M not only upward but also sideward or downward to cause cavitation, in order to achieve washing by water alone.

Since this invention is configured and functions as described above, cavitation may be enhanced by jetting a near-infinite number of bubbles against the desired target area of the material through the pressurized water flow. When the bubbles then burst on the surface of the material, the resulting disturbance and shock waves and the impact of the water flow serve to wash the target area. Thus, the movement of the bubbles, which is very important in water-only washing processes is controlled to substantially improve the practicality of the underwater washing method. As a result, a washing method that does not cause pollution can be provided to improve the environment.

I claim:

1. A method of washing material submerged in a body of water comprising introducing a jet of water under pressure into said body of water, inducing outside gas to flow into said body of water with said jet thereby creating a stream of bubbles mixed with said jet and directing said jet and stream of bubbles against the material to wash the material by turbulent forces produced by said jet and cavitation caused by bursting of the bubbles.

2. A method as claimed in claim 1 wherein the gas is air.

3. A method as claimed in claim 1 including the step of pressurizing the gas.

4. A method as claimed in claim 1 wherein the gas is induced to flow into said body of water around said jet.

5. A method of washing material submerged in a body of water comprising introducing a jet of water under pressure into said body of water, inducing outside gas to flow into said body of water with said jet thereby creating a stream of bubbles mixed with said jet and directing said jet and stream of bubbles against the material to wash the material by turbulent forces produced by said jet and cavitation caused by bursting of the bubbles, wherein said jet has a longitudinal axis and the method includes rotating the jet around another axis parallel to said longitudinal axis.

6. A method as claimed in claim 5 wherein the gas is air.

7. A method as claimed in claim 5 including the step of pressurizing the gas.

8. A method as claimed in claim 5 wherein the gas is induced to flow into said body of water around said jet.

9. A device for washing material submerged in water comprising a washing vessel for receiving a body of water, support means in said vessel for supporting material to be washed submerged in said body of water, a water pipe extending through a wall of said vessel terminating in a nozzle for directing a jet of water under pressure against material on said support means and gas piping surrounding said water pipe for inducing outside gas to flow into said body of water with said jet to create a stream of bubbles mixed with the jet, wherein said water pipe and said gas piping are replicated in a radial array about a central axis, and wherein said radial array is mounted for rotation about said central axis.

10. A device as claimed in claim 9 wherein said water pipe is received in said gas piping and said gas piping extends into said vessel beyond said nozzle.

11. A device as claimed in claim 9 including gas pressurizing means connected with said gas piping.

* * * * *